US006543764B1

(12) United States Patent
Mallok

(10) Patent No.: US 6,543,764 B1
(45) Date of Patent: Apr. 8, 2003

(54) METHOD FOR SEPARATING OUT INDIVIDUAL SHEETS IN A PRINTING MACHINE

(75) Inventor: Andreas Mallok, Wiesloch (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 130 days.

(21) Appl. No.: 09/718,898

(22) Filed: Nov. 22, 2000

(30) Foreign Application Priority Data

Nov. 22, 1999 (DE) ..... 199 56 099

(51) Int. Cl.[7] ..... B65H 29/68; B65H 29/04
(52) U.S. Cl. ..... 271/183; 271/204; 271/280
(58) Field of Search ..... 271/183, 204, 271/205, 206, 279, 280

(56) References Cited

U.S. PATENT DOCUMENTS 2,130,841 A * 9/1938 Eckhard ..... 271/183
4,830,355 A * 5/1989 Jeschke ..... 271/183
5,348,285 A * 9/1994 Huser ..... 271/183
5,390,911 A * 2/1995 Schmid ..... 271/204
5,649,483 A 7/1997 Mack et al.
6,036,187 A * 3/2000 Schaede ..... 271/204
6,056,287 A 5/2000 Hirth et al.

FOREIGN PATENT DOCUMENTS

DE 36 38 494 A1 * 8/1987 ..... 271/204
DE 195 19 374 C2 11/1996
DE 196 20 938 A1 11/1997

* cited by examiner

*Primary Examiner*—Michael R. Mansen
(74) *Attorney, Agent, or Firm*—Laurence A. Greenberg; Werner H. Stemer; Ralph E. Locher

(57) ABSTRACT

A method separates out individual sheets from a sheet-processing machine, by a revolving gripper chain bearing grippers for gripping the sheets one after another at a leading edge thereof and conveying them with a given mutual travel spacing and a given conveying speed to a stacking region for deposition. A separating device is disposed beyond the stacking region. The separating device has a controllable revolving suction belt for conveying individual sheets. The suction belt is accelerated to the conveying speed and the individual sheets are conveyed to the separating device. The individual sheets are picked up with the suction belt, and the grippers are opened. The suction belt is briefly decelerated so as to withdraw the respective sheet from the grippers. The suction belt is accelerated again to at least the conveying speed. The suction belt is subsequently decelerated to a given output speed.

3 Claims, 3 Drawing Sheets

METHOD FOR SEPARATING OUT INDIVIDUAL SHEETS IN A PRINTING MACHINE

BACKGROUND OF THE INVENTION

FIELD OF THE INVENTION

The invention relates to a method for separating out individual sheets from a sheet-processing machine, in particular, at the delivery of a printing machine with pile or stack formation, by a revolving gripper chain having gripper bars extending transversely to the sheet conveyance direction, and grippers which are arranged on the gripper bars and successively grip the sheets at the leading edge thereof and convey them to a stacking or pile region to be deposited, whereat, in order to separate out the sheets, they are conveyed over and beyond the stacking or pile region and, at a predefinable location, are transferred to a separating device having a controllable revolving suction belt for braking and separating out the sheets.

In order to assess or evaluate the printed image in a printing machine, individual printed sheets, so-called proofs, must be removed at regular intervals during progressive operation. In the case of stack-building or pile-forming printing machines, these proofs have heretofore been removed manually from the progressively forming stack or pile.

German Patent 195 19 374 describes a device for automatically separating out individual printed sheets with the aid of a second separating device arranged behind the stacking region and serving for conveying an incoming sheet out of the delivery of the machine and depositing it on an extensible table. The desired sheets are drawn beyond the stack region to the aforementioned second separating device by a gripper chain revolving continuously at the machine cycle rate in order to convey the printed sheets, and are transferred, at the second separating device, to a revolving suction belt, instead of being deposited on the sheet pile as usual.

Through the intermediary of the revolving suction belt, the sheets are braked to an output speed. In the course of the braking, the sheets behave differently, depending upon the stiffness of the paper, and the machine speed. Failures or faults occur because of sheets entrained by the grippers, as well as due to collisions with succeeding sheets at high machine speed.

SUMMARY OF THE INVENTION

It is accordingly an object of the invention of the instant application to provide a method of separating out individual sheets in a printing machine, which functions reliably and irrespectively of the paper being processed and the speed of the machine.

With the foregoing and other objects in view, there is provided, in accordance with one aspect of the invention, a method for separating out individual sheets from a sheet-processing machine, by a revolving gripper chain having gripper bars extending transversely to a direction wherein the sheets are being conveyed, and grippers arranged on the gripper bars for gripping the sheets one after another at a leading edge thereof and conveying them to a stacking region for deposition, whereat, the sheets to be separated out are conveyed over and beyond the stacking region and, at a predefinable location, are transferred to a separating device having a controllable revolving suction belt for braking and separating out the sheets, which comprises bringing the suction belt to sheet speed, picking up with the suction belt a respective sheet to be separated out, and opening the grippers, somewhat braking the suction belt briefly and, after withdrawal of the respective sheet from the grippers, accelerating the suction belt again to at least the previous speed thereof, and outputting the respective sheet while it is being braked.

In accordance with another mode, the method of the invention for separating out individual sheets, includes performing the separation at a delivery of a printing machine capable of sheet pile formation.

In accordance with a further mode, the method of the invention includes, after the respective sheet has been withdrawn from the grippers, accelerating the respective sheet beyond the original speed thereof, and reestablishing the original travel spacing of the respective sheet from the next following sheet before braking the respective sheet.

In accordance with an added mode, the method of the invention includes, after the respective sheet has been withdrawn from the grippers, accelerating the respective sheet beyond the original speed thereof, and moving it farther away from the next following sheet a spaced distance greater than the spaced distance originally therebetween, and then outputting the respective sheet while it is being braked.

In accordance with an additional aspect of the invention, there is provided a method for separating out individual sheets from a sheet-processing machine, by a revolving gripper chain having gripper bars extending transversely to the direction in which the sheets are being conveyed, and grippers arranged on the gripper bars for gripping the sheets one after another at a leading edge thereof and conveying them to a stacking region for deposition thereat, further conveying the sheets to be separated out, over and beyond the stacking region and transferring the sheets, at a predefinable location, to a separating device having a controllable revolving suction belt for braking and separating out the sheets, which comprises, upon the arrival of a sheet to be separated out, bringing the suction belt to sheet speed, applying suction by the suction belt to the sheet, opening the grippers, accelerating the suction belt to a higher speed, after releasing the sheet from the grippers, and then outputting the sheet while braking the sheet.

In accordance with yet another aspect of the invention, there is provided a sheet-processing machine capable of sheet stack formation, having a device for separating out individual sheets by a revolving gripper chain having gripper bars extending transversely to a sheet-conveyance direction, and grippers arranged on the gripper bars for gripping the sheets one after another at a leading edge thereof and conveying them to a stacking region for deposit thereat, the sheets to be separated out being conveyable over and beyond the stacking region and, at a predefinable location, being transferrable to a separating device having a controllable revolving suction belt for braking and separating out the sheets, comprising equipment for bringing the suction belt to sheet speed, for causing a sheet, that is to be separated out, to be picked up by the suction belt, for opening the grippers, for braking the suction belt briefly, and for accelerating the belt again to at least the previous speed thereof, after the sheet has been withdrawn from the grippers, and for finally outputting the sheet while braking it.

In accordance with yet a further aspect of the invention, there is provided a sheet-processing machine capable of sheet stack formation, having a device for separating out individual sheets by a revolving gripper chain having gripper bars extending transversely to the direction in which the sheets are being conveyed, and grippers arranged on the gripper bars for gripping the sheets one after another at a leading edge thereof and conveying them to a sheet stacking region for deposit thereat, the sheets to be separated out being conveyable over and beyond the stacking region and, at a predefinable location, being transferrable to a separating device having a controllable revolving suction belt for braking and separating out the sheets, comprising equipment by which, upon the arrival of a sheet to be separated out, the suction belt is bringable to sheet speed, for causing the sheet to be picked up by the suction belt, for opening the grippers, for accelerating the suction belt to a higher speed, after releasing the sheet from the grippers, and for finally outputting the sheet while braking it.

In accordance with a concomitant feature of the invention, the sheet-processing machine is a rotary printing machine, and the device for separating out individual sheets is located at a delivery of the rotary printing machine.

When a stiff paper quality is being used, the aforestated object of the invention is readily achievable. However, when stiff paper is being processed, jamming of the sheets in the already opened grippers can occur, so that the sheets are not released from the grippers, which results in the sheets being drawn into the machine again. As a result of the brief braking of the suction belt, the sheets are drawn out of the grippers. In order not to collide with the next following sheets, however, the respective sheet released in this manner must be transported onward by the belt without any delay and at normal speed, and finally separated out. For this purpose, the belt is accelerated again to the original speed thereof. The sheet can finally be deposited on a shelf secured to the outside of the machine delivery, or else in a tray, and can be removed.

In order to ensure a smooth operation when removing a proof, even at high machine speed, provision can be made for the sheet, after being pulled out of the grippers, to be accelerated beyond the original speed, and the original spacing thereof from the next following sheet during travel to be reestablished before the sheet is braked. In this way, the loss in terms of distance which the sheet has experienced with respect to the next following sheet as a result of the brief braking is compensated for again. The situation is therefore avoided wherein the next following sheet runs onto the separated-out sheet at high machine speed.

In order to separate a number of successive sheets of heavy paper (above about 240 $g/m_2$), for each of the sheets to be separated out, provision can be made for the sheet, after being pulled out of the gripper, to be accelerated beyond the original speed, and to be moved further away from the following sheet than was originally the case, and for the sheet to be finally output while being braked. As a result of the brief braking, the distance from the following sheet is reduced, is compensated for again by the acceleration beyond the original speed and is further increased beyond the original value. In this way, it is possible for a number of heavy sheets to be removed one after another without any collisions occurring.

In order to separate out a number of successive sheets of lightweight paper (up to about 240 $g/m^2$), and in order to achieve the object of the invention, for each of the sheets to be separated out, provision can be made that, upon the arrival of a sheet to be separated out, the suction belt be brought to sheet speed, that the sheet be picked up by the suction belt and the grippers be opened, that the suction belt, after detaching the sheet from the grippers, be accelerated to a higher speed, and that the sheet be finally outputted while being braked. As a result of the extra increase in the speed, a spaced distance from the next following sheet can be built up, which permits the reliable braking and removal of the sheet before the next sheet is delivered to the separating device.

Other features which are considered as characteristic for the invention are set forth in the appended claims.

Although the invention is illustrated and described herein as embodied in a method for separating out individual sheets in a printing machine, and a device for performing the method it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

Identical parts are identified by the same reference characters in all of the figures.

DESCRIPTION OF THE PREFERRED EMBODIMENTS

Figure 1:
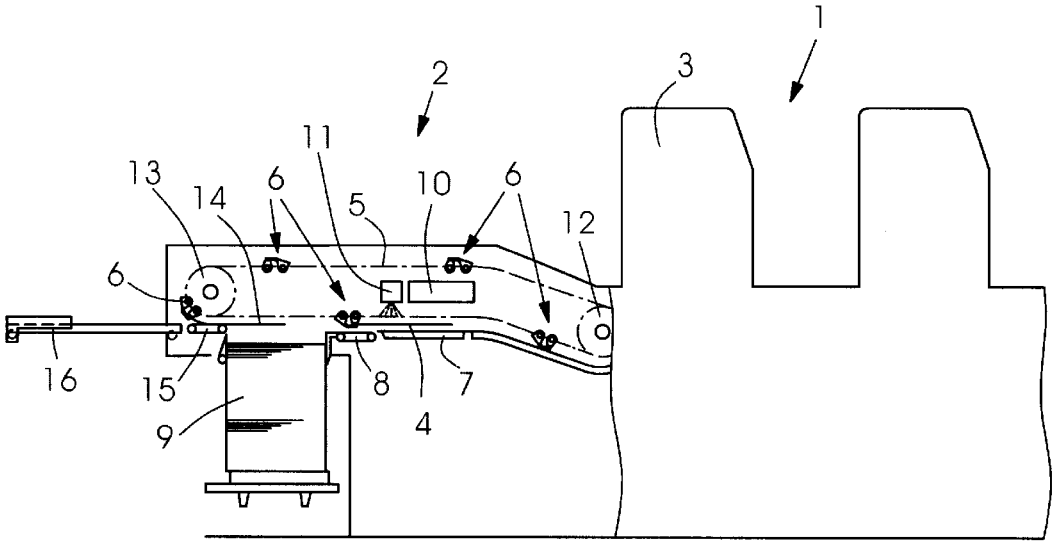
FIG. 1 is a diagrammatic side elevational view of a printing machine, partly broken away to show a separating device controllable in accordance with the invention.

Referring now to the drawings and, first, particularly to FIG. 1 thereof, there is illustrated therein part of a rotary printing machine 1 wherein a delivery 2 follows a last printing unit 3. From the printing unit 3, printed sheets 4 are picked off by a gripper chain 5 shown in phantom, which has grippers 6 fixed thereto, and are transported over a sheet guiding device 7 and a sheet brake 8 to a sheet pile or stack 9 and deposited thereat. In order to avoid set-off and sticking of the sheets 4 on the sheet pile 9 and in order to accelerate the drying process, the sheets 4 are conveyed underneath a dryer 10 and past a powdering device 11, at which they are powdered with a drying agent. The gripper-chain 5 travels over a drive wheel 12 and a deflection roller 13. It is guided by non-illustrated guide tracks.

In order to separate out proofs 14 or rejects, a separating device is provided which, as shown in FIG. 1, includes a further braking belt 15 and an extensible shelf 16.

The plot diagrams or graphs of FIGS. 2 to 6, respectively, show qualitatively, the speed profile of the further braking belt 15 when a sheet 14 to be separated out is delivered. The profile can be achieved by appropriately driving the drive motor of the braking belt 15.

Figure 2:
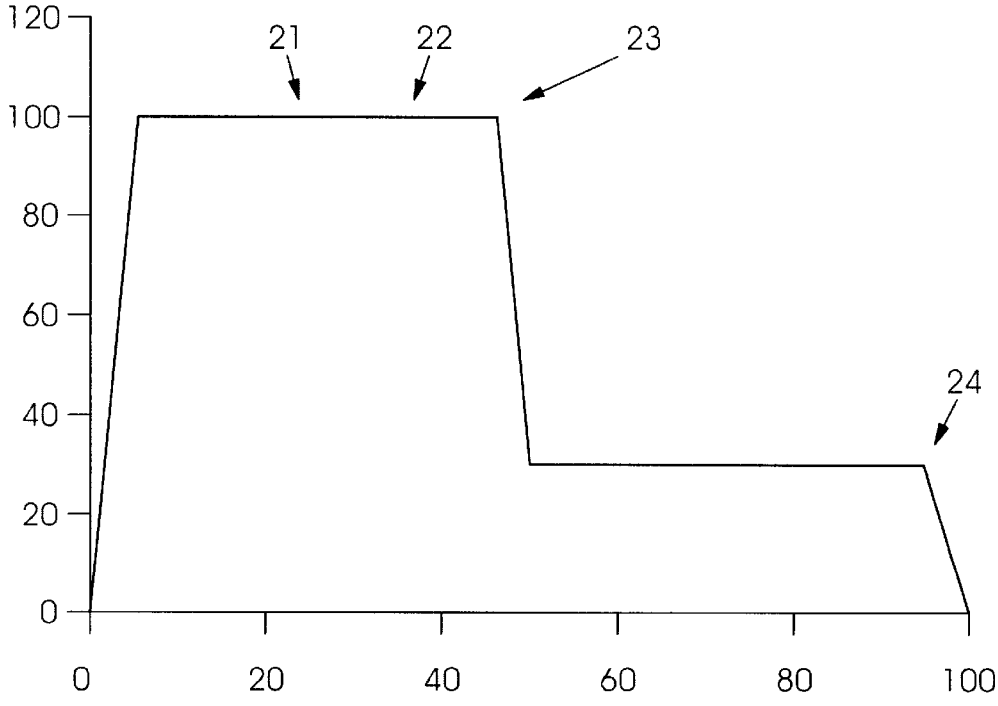
FIG. 2 is a plot diagram of the braking profile when removing individual sheets of a lightweight paper quality (up to about 240 $g/m^2$)

In order to remove an individual sheet of a lightweight paper quality, as shown in FIG. 2, the braking belt 15 is accelerated to the speed of the arriving sheet (100%= machine speed). At the location 21 on the profile, the gripper dragging the sheet is at the level of the braking belt 15, and at the location 22, the gripper dragging the sheet is at the level of the shelf 16. The sheet is picked up by the braking belt 15 and, after the grippers have been released, i.e., after the location 23 on the profile, can be braked by reducing the belt speed. The retarded sheet is conveyed at constant speed as far as the shelf 16 at the location 24 on the profile. The braking belt 15 is thereafter stopped.

Figure 3:
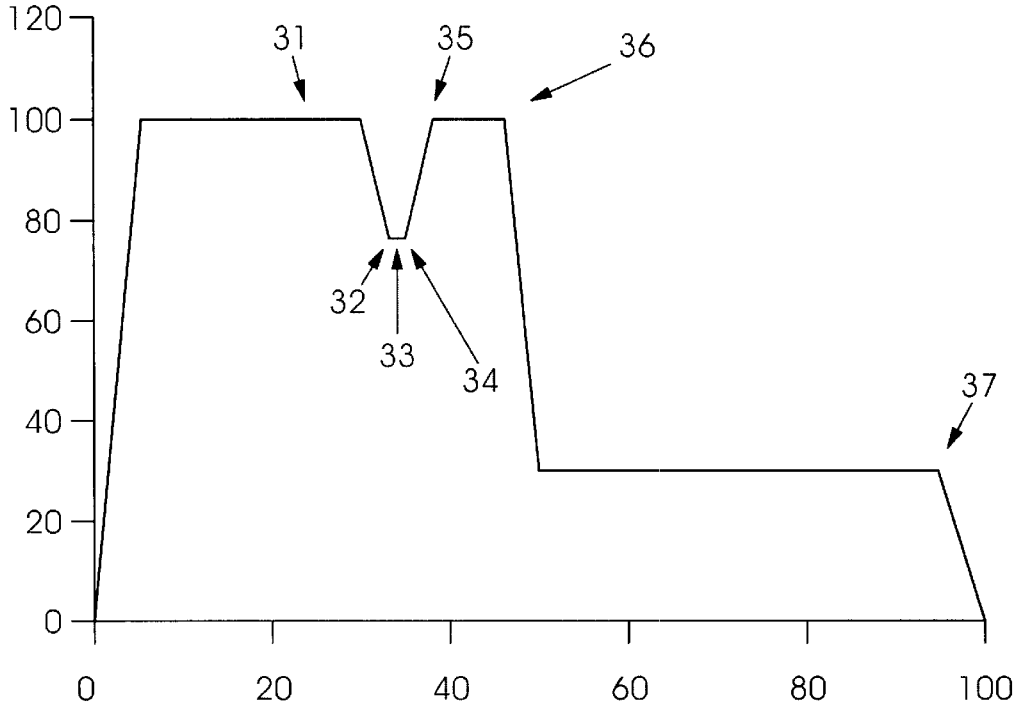
FIG. 3 is a plot diagram of the braking profile when removing individual sheets of a heavy paper quality (above about 240 $g/m^2$)

In order to remove an individual sheet of heavy paper quality, according to the invention, as shown in FIG. 3, the braking belt 15 is accelerated to machine speed, and the sheet is picked up at the location 31 on the profile. The sheet is then braked at the location 32 on the profile for a brief time following the opening of the grippers and is pulled out of the grippers at the location 33 on the profile. This avoids the situation wherein the sheet jams in the grippers and is not released automatically, which may occur in the case of heavy paper. From the location 34 on the profile, the sheet is then accelerated again to the original speed at location 35, in order to keep the loss of spaced distance produced by the brief braking as small as possible and in order to avoid any collision with the next following sheet. At the location 36, the sheet is then braked, as previously, and deposited at the location 37.

Figure 4:
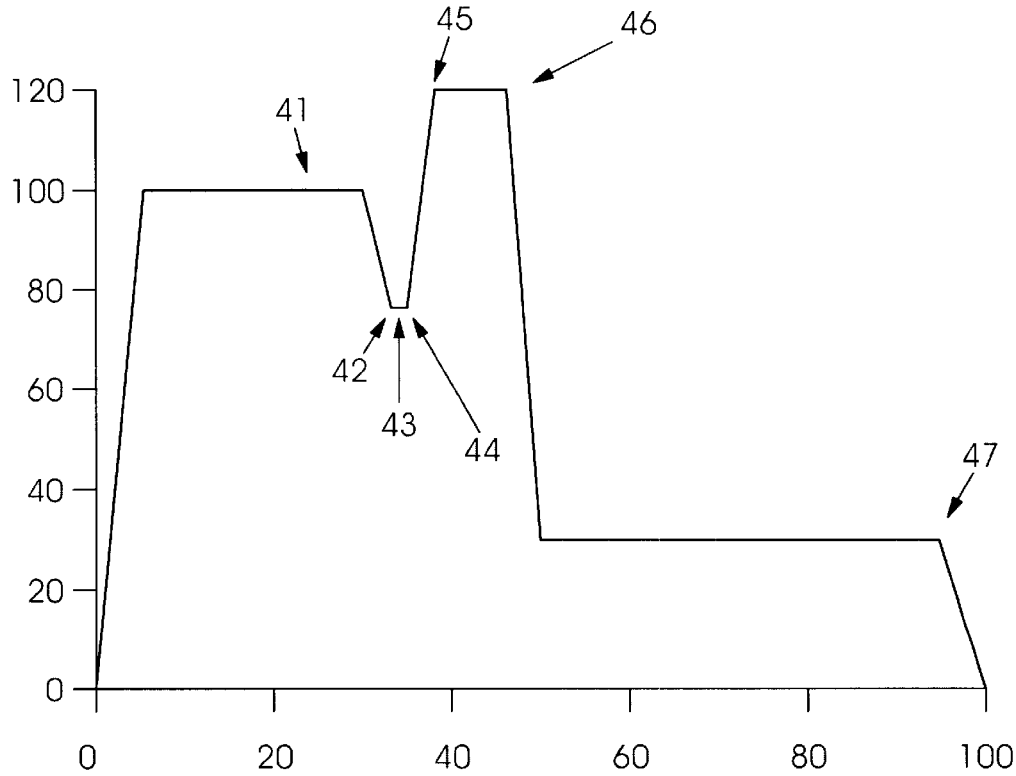
FIG. 4 is a plot diagram of the braking profile when removing individual sheets of a heavy paper quality (above about 240 $g/m^2$) in the case of a large format or high-speed machine.

In order to output an individual sheet of heavy paper quality in the case of a large format or in a high-speed machine, the sheet, as shown in FIG. 4, is removed from the grippers at the locations 41 to 44 on the profile as in the preceding example. Thereafter, however, the loss of distance that results is recovered by the sheet being accelerated beyond the original speed and, from the location 45, travelling more rapidly than the next following sheet. As a result, any collision with the next following sheet is avoided. From the location 46, the sheet is then braked, as before, and deposited at the location 47.

Figure 5:
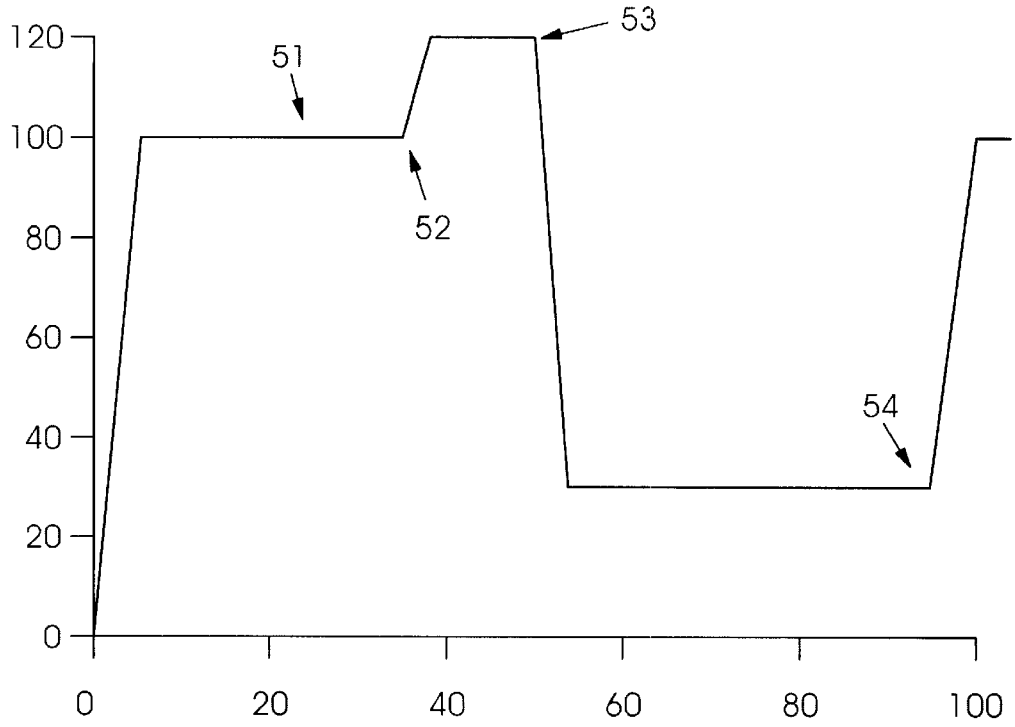
FIG. 5 is a plot diagram of the braking profile when removing a number of sheets of a lightweight paper quality (up to about 240 $g/M^2$)

In order to deposit several successive sheets of lightweight paper quality, as shown in FIG. 5, a respective sheet picked up by suction at the location 51 and released from the grippers is accelerated, from the location 52, in order to increase the distance from the next following sheet. As a result of the gap produced relative to the next following sheet, sufficient clearance remains for the braking operation which begins at the location 53, without any danger of the next following sheet running into the respective preceding sheet. At the location 54, the sheet is deposited and the procedure begins again.

Figure 6:
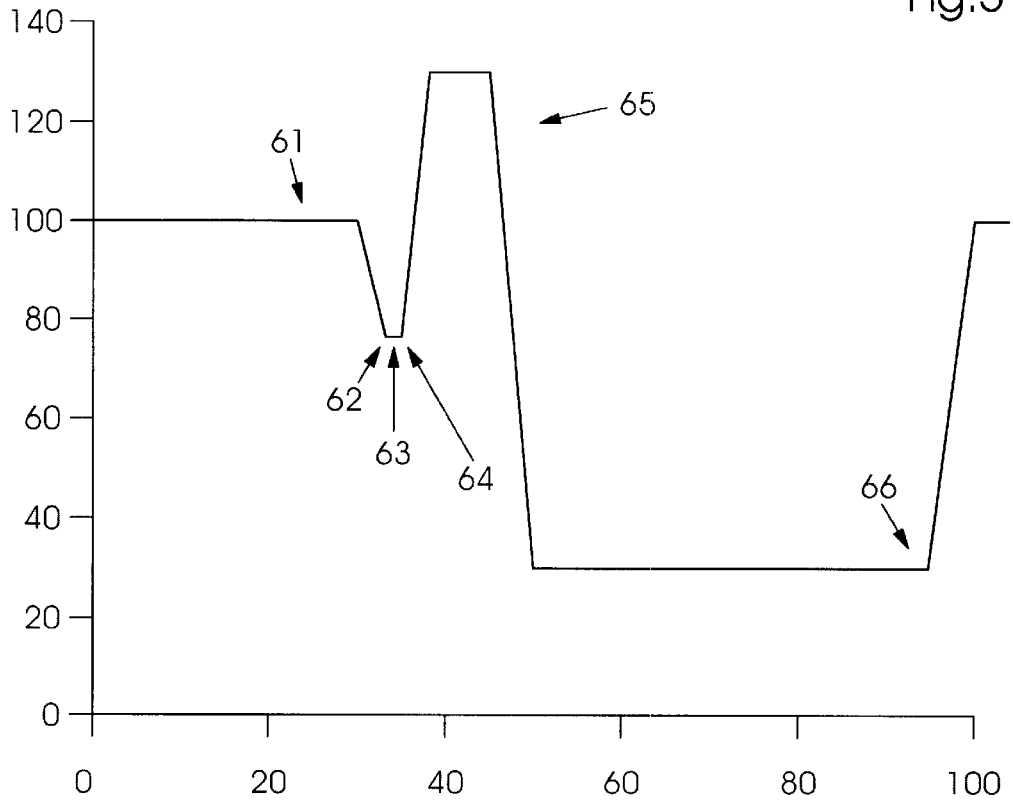
FIG. 6 is a plot diagram of the braking profile when removing a number Of sheets of a heavy paper quality (above about 240 $g/M^2$).

If a number of sheets of heavy paper quality are to be output, then, in accordance with FIG. 6, each sheet, after it has been picked up by suction by the braking belt at the location 61, has to be pulled or drawn out of the grippers at the locations 62 to 64. In order to recover the loss of spaced distance produced thereby, the sheet is again accelerated beyond the speed of the next following sheet and kept at the high speed until it reaches the location 65. After being braked, the sheet is once again conveyed to the shelf 16 and finally deposited at the location 66. In order to receive the next following sheet, the braking belt 15 is then accelerated again.

I claim:

1. A method for seperating out at least one individual sheet of a plurality of sheets from a sheet-processing machine, which comprises:

providing a revolving gripper chain bearing grippers for gripping the sheets one after another at a leading edge thereof and conveying them with a given mutual travel spacing and a given conveying speed to a stacking region for deposition;

providing a separating device beyond the stacking region, the separating device having a controllable revolving suction belt for conveying the individual sheet;

accelerating the suction belt to the conveying speed and conveying the individual sheet to the separating device;

picking up with the suction belt the individual sheet;

opening the grippers;

decelerating the suction belt briefly for withdrawing the individual sheet from the grippers;

accelerating the suction belt again to at least the conveying speed; and subsequently decelerating the suction belt to a given output speed.

2. The method according to claim 1, which includes, after withdrawing the individual sheet from the grippers and before decelerating the auction belt to the given output speed, accelerating the suction belt beyond the conveying speed for regaining a loss of the given mutual travel spacing resulting from briefly decelerating the suction belt.

3. The method according to claim 1, which includes, after withdrawing the individual sheet from the grippers and before decelerating the suction belt to the given output speed, accelerating the individual sheet beyond the conveying speed for moving the individual sheet farther away from the next following sheet a spaced distance greater than the given mutual travel spacing.

* * * * *